US005239236A

United States Patent [19]

Bäckström et al.

[11] Patent Number: 5,239,236

[45] Date of Patent: Aug. 24, 1993

[54] FIELD LIGHTING NETWORK WITH A DISTRIBUTED CONTROL SYSTEM

[75] Inventors: Göran Bäckström, Östersund; Kjeld Thorborg, Onsala, both of Sweden

[73] Assignee: Airport Technology in Scandinavia AB, Froesoen, Sweden

[21] Appl. No.: 829,090

[22] PCT Filed: Sep. 12, 1990

[86] PCT No.: PCT/SE90/00582

§ 371 Date: Feb. 13, 1992

§ 102(e) Date: Feb. 13, 1992

[87] PCT Pub. No.: WO91/04647

PCT Pub. Date: Apr. 4, 1991

[30] Foreign Application Priority Data

Sep. 14, 1989 [SE] Sweden ..... 8903028

[51] Int. Cl.[5] ..... H05B 37/00

[52] U.S. Cl. ..... 315/185 R; 315/187; 315/256

[58] Field of Search ..... 315/185 R, 186–189, 315/193, 220, 250, 256

*Primary Examiner*—David Mis

*Attorney, Agent, or Firm*—Townsend and Townsend Khourie and Crew

[57] ABSTRACT

A field lighting network providing for individual control of the light fittings while reducing overall cable costs. A converter unit converts a supply voltage obtained from an A.C. main to a substantially constant current in a Boucherot circuit with a series resonance circuit, tuned to the main frequency. The converter unit includes a Boucherot circuit having a series resonance circuit, substantially tuned on the main frequency, and an additional inductance in series with a load connected to the converter unit. A regulator unit supplied with current couples to each fitting or group of fittings for individual regulation of the current passing through the respective lamp or lamps. Each regulator unit is disposed to receive control information on the power cable.

8 Claims, 4 Drawing Sheets $X = L\omega = \frac{1}{C\omega}$

PE
CO
P
12V
0
N
C1
R
RE
CO
PE
P
0
2
4
6
8
24
26
28
30
32
34
36
38
40
42
44
48

FIELD LIGHTING NETWORK WITH A DISTRIBUTED CONTROL SYSTEM

BACKGROUND OF THE INVENTION

The present invention relates to a field lighting network including a plurality of series-connected light fittings, supplied from an A.C. main via a converter unit adapted to convert the substantially constant voltage obtained from the main to a substantially constant current in outgoing current lines containing the fittings.

A network of this kind is described in U.S. Pat. No. 4,754,201.

The traditional method of controlling and monitoring field lights on an airfield is to supply power to the different light configurations via a so-called parallel system or a so-called series system (FIGS. 1 and 2). In such a case, the regulating and monitoring unit is centrally placed in a cabinet or the like, and its regulators provide either a constant voltage (parallel system) or a constant current (series system) to the different power supply cables of the different field light configurations.

The object of the present invention is to provide a field lighting network of the kind described above, wherein individual control of the light fittings, or groups thereof, is possible while cable costs are considerably reduced at the same time.

SUMMARY OF THE INVENTION

In the field lighting network according to the present invention different light configurations are supplied by one or more transformers, implemented in such a way that they may be regarded as representing current supply sources. Each light fitting is provided with a local regulating and monitoring unit, which obtains its control information via signals carried by the power cable, a separate control cable or by radio. In the field lighting network of the present invention there is thus used a "current supply" network where the prevailing output voltage is a function of the prevailing load.

The advantages accompanying the use of such a current supply system in a field lighting network for airfields are as follows:

1) The lamps have a resistance that varies greatly, depending on the filament temperature. A current supplying system provides a smooth successive voltage increase across the lamp, whereas a voltage supplying system results in severe current surges when the lamp is turned on.

2) The lamps are spread over large areas, and if a current supplying system is used, single conductor, high-voltage cables, typically for 5 kW, can be used for the supply, which considerably reduces cable costs.

3) Current transformers are cheaper than corresponding voltage transformers.

In a preferred embodiment of the network of the present invention the converter unit adapted for converting the voltage obtained from the A.C. main to a substantially constant current is a Boucherot circuit with a series resonance circuit, tuned to the main frequency. This is a simple and advantageous method of obtaining a current source having an indefinite EMF behind an infinite impedance. The Boucherot circuit is described more in detail by E. Arnold, Die Wechselstromtechnik, Erster Band, Zweite Auflage, Verlag Julius Springer, Berlin, pp 141–4.

According to another embodiment of the network of the present invention the converter unit includes a further inductance in series with a load connected to the converter unit. If this inductance is of the same magnitude as the one included in the series resonance circuit, during idling (i.e. short-circuiting of the current system), the current in the network ideally will be zero.

Another advantage in the utilization of this special Boucherot circuit is that the effect on the network is small and that the sinus wave shape remains essentially unaffected, which facilitates signal transmission over the power cables. The Boucherot circuit is generally advantageous in applications for airfields, where a low interference level is essential.

In accordance with a further embodiment of the network according to the invention, the regulating unit includes a counter synchronized with the current zero crossings and provided with its own oscillator controlled by a binary number. This binary number can be varied individually for each lamp, and is determined, preferably, from a central control system.

In accordance with a still further embodiment of the present invention the regulating unit includes a triac connected in parallel with the light fitting lamp, for regulating the current through the lamp by controlling the ignition time.

The network, in accordance with the invention, also preferably includes a safety system having three levels, since a fault that could lead to an open circuit would cause impermissibly high voltages. The network according to the invention therefore includes transient protection, primarily in the shape of a component (e.g. a type of two-way Zener diode), which is connected across each lamp and which is short-circuited (not interrupted) when it is driven outside its operating range. As further protection, the triac can be disposed such that in response to overvoltage occurring across the lamp it is forced to a permanent "on" state for short-circuiting the transients, and, as a third protection means, there can be arranged a (mechanical and/or electronic) device for short-circuiting any occurring overvoltages, if these are not short-circuited by the other protective means.

In order to explain the invention in more detail, an embodiment of the network according to the invention, selected as an example, will be described with reference to the diagrams below.

Figure 4A:
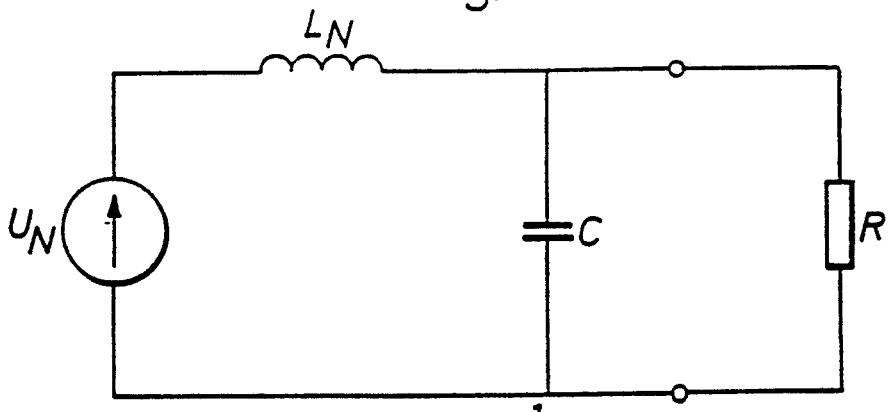
Figure 4B:
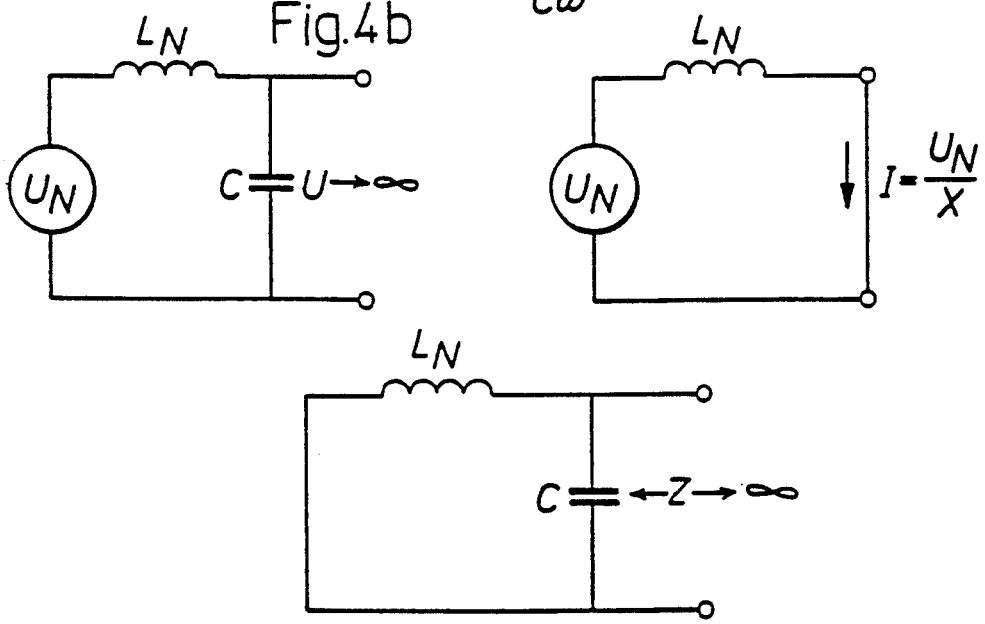
Figure 5:
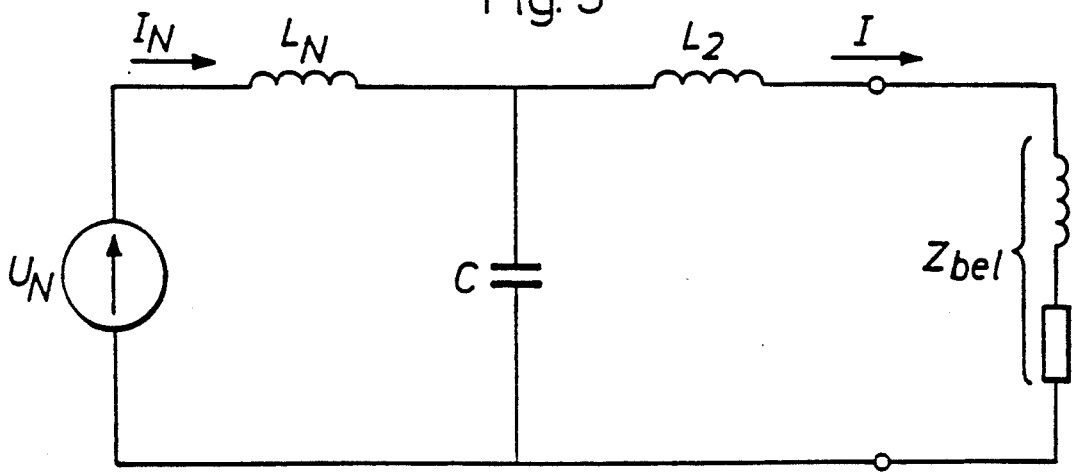
Figure 6:
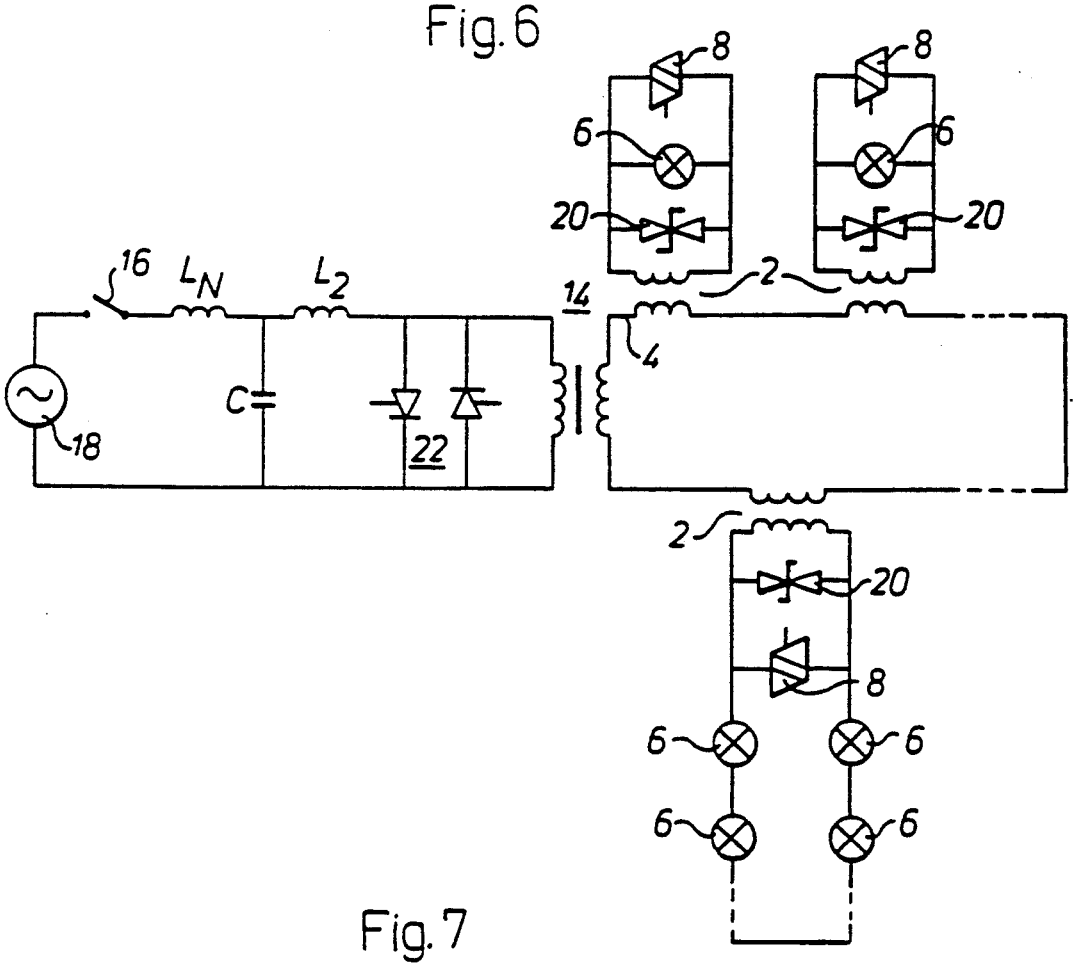
Figure 7:
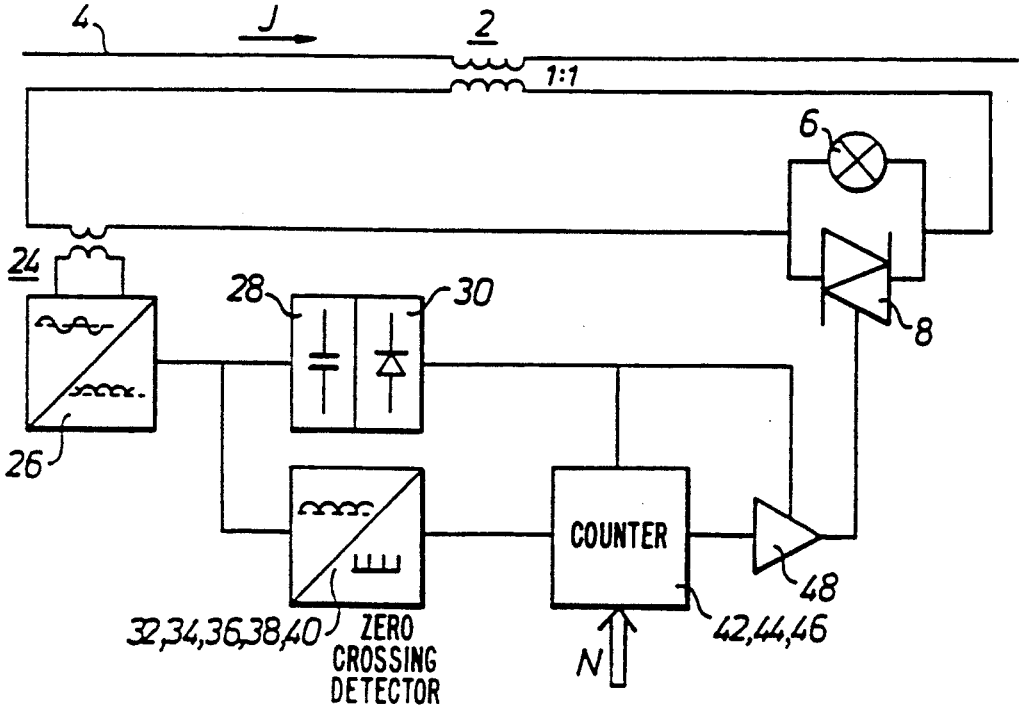
Figure 8:
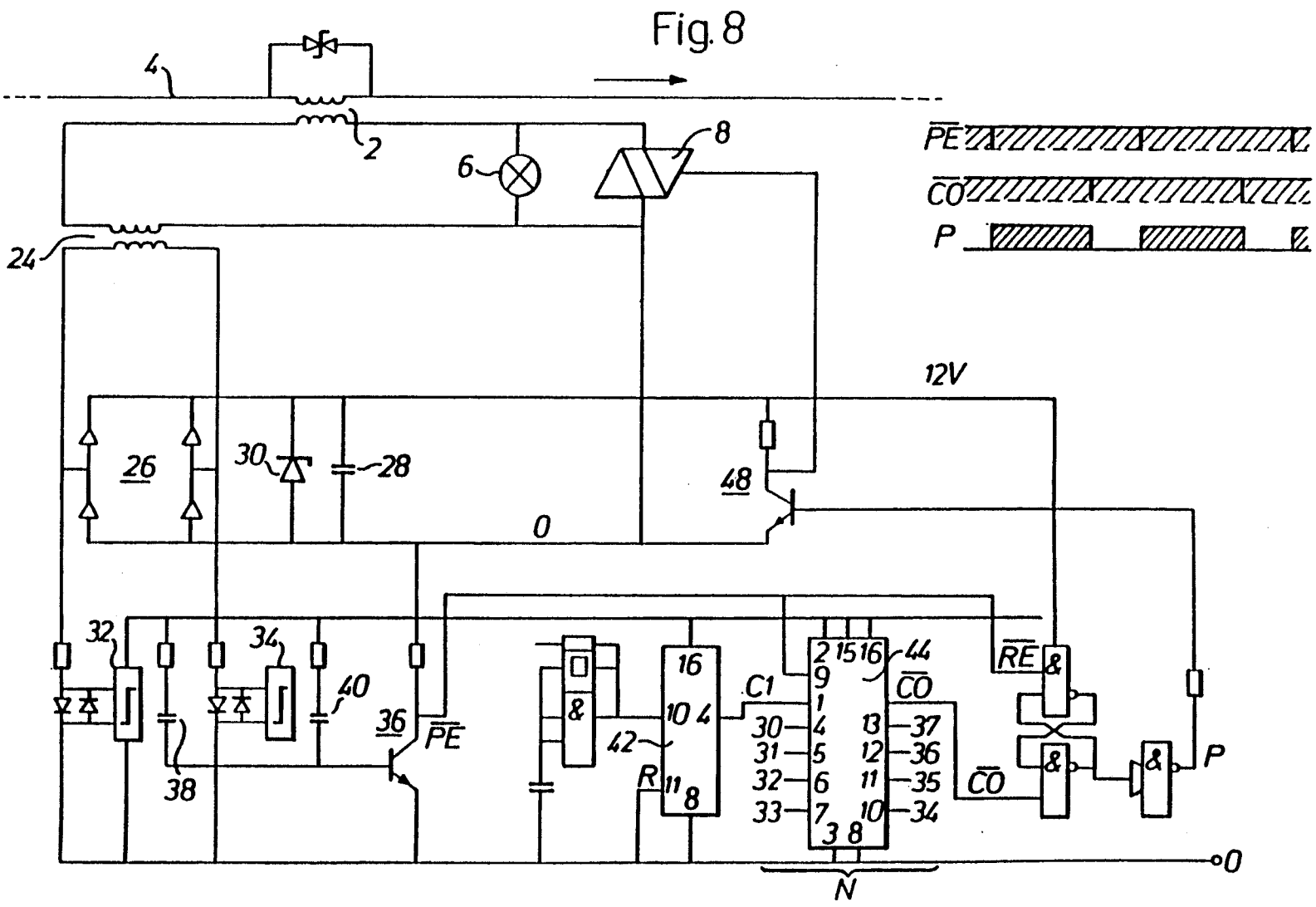

FIG. 4*a* illustrates the basic implementation of a Boucherot circuit included in the converter unit of the network according to the present invention;

FIG. 4*b* illustrates the electrical properties of the circuit;

FIG. 5 illustrates a further refinement of the Boucherot circuit;

FIG. 6 illustrates the further developed Boucherot circuit of FIG. 5 included in the network according to the invention;

FIG. 7 schematically illustrates an example of a local regulating and monitoring unit in the network according to the invention; and FIG. 8 illustrates the unit of FIG. 7 in more detail.

DESCRIPTION OF THE PREFERRED EMBODIMENTS

Figure 1:
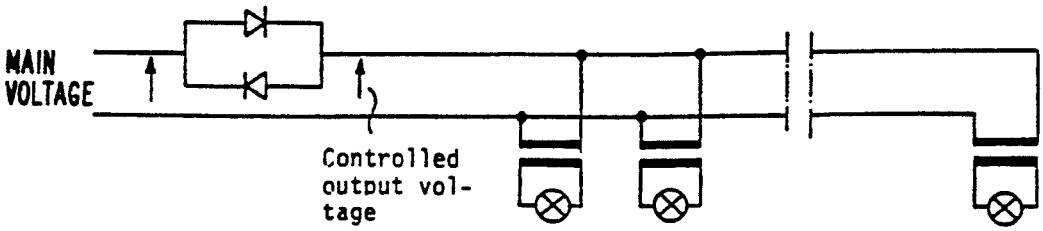
Fig. 1 (PRIOR ART)
FIGS. 1 and 2 illustrate the principles of parallel and series supply, respectively, for field lightings on an airfield, according to prior art.
Figure 2:
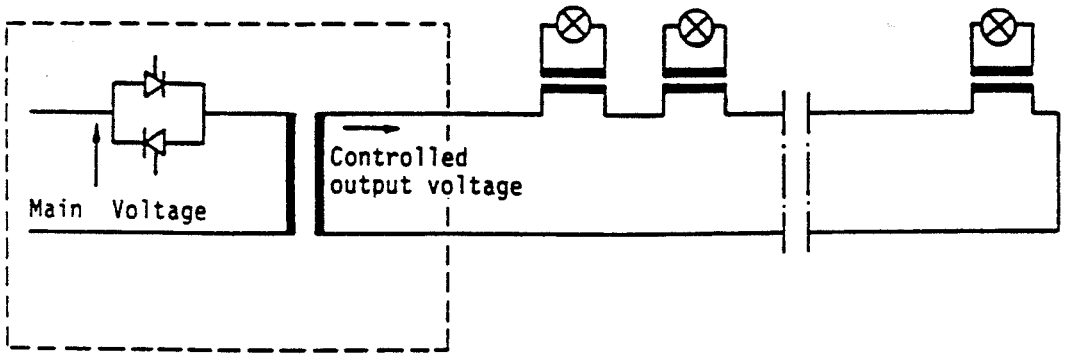
Fig. 2 (PRIOR ART)
Figure 3:
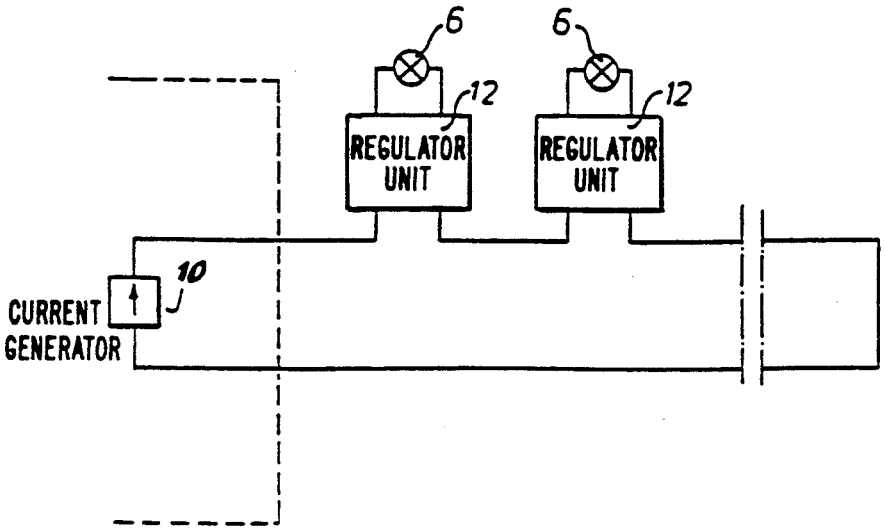
FIG. 3 illustrates the principle of the network according to the present invention.

In FIG. 3 there is schematically illustrated an embodiment of the network according to the invention, in which a series system of a plurality of light fittings is supplied from a current generator 10. Each fitting includes a lamp 6 as well as a local regulating and monitoring unit 12. The output voltage is not regulated, and becomes a function of the prevailing load. The regulating and monitoring units 12 are given their control information, from a central control system, by signals carried on the power cable, a separate control cable or by radio.

The current source is realized by a converter unit supplied from an A.C. main having substantially constant voltage. This converter unit converts the voltage obtained from the main to a substantially constant current in the outgoing lines that include the light fittings.

The converter unit includes a Boucherot circuit, illustrated in its basic implementation in FIG. 4*a*. The circuit contains a series resonance circuit formed of an inductance $L_N$ and a capacitor C and is tuned substantially to the main frequency.

The properties of the Boucherot circuit are as follows. When it is supplied with the voltage $U_N$ from the main the voltage seen from the load side is infinitely great when the load impedance goes towards infinity, and for a short-circuited load, the impedance is formed of the reactance in the inductance $L_N$ (FIG. 4*b*).

Applying Thevenin's theorem, the circuit may be represented by an infinitely great EMF behind an infinite impedance (i.e. it constitutes a current source). The magnitude of the current is: $I=U_N/X$, where $X=\omega L_N$ is the reactance of the inductance, and this current is equal to the short-circuiting current. In case of a short-circuit, the current in the load line $L_N=I$ and is purely inductive.

In FIG. 5 there is shown a further refinement of the Boucherot circuit, which is used in the network according to the present invention. In this embodiment a second inductance $L_2$ is connected in series with the load $Z_{bel}$. If the inductance $L_2$ is of the same magnitude as the series resonance circuit inductance $L_N$, one of the advantages of this embodiment is that the main current $L_N$ is equal to zero when the system is short-circuited, i.e., in a no-load state, since $L_2$ and C are in parallel resonance.

In the description thus far of the Boucherot circuit the load has been assumed to be linear, namely a resistance in series with an (ideal) inductance. In the network according to the invention, the load consists of a resistance, i.e. the lamp 6, which is connected in parallel with a triac 8 (FIGS. 6–8). The effective value of the current through the lamp can then be varied by varying the ignition angle of the triac 8. This combined load is non-linear, but in spite of this the current from the Boucherot circuit is practically sinusoidal, due to the inductance $L_2$ at the output. As previously mentioned, this affords important advantages.

When the triac 8 is disconnected at the beginning of each half period the Boucherot circuit is resistively loaded, and when the triac 8 is connected for the rest of the half period the Boucherot circuit is short-circuited. The wave form of the voltage across the load is also formed of a portion of a sinus form that can be divided into fundamental tone and overtones. The overtones will be (almost) filtered away by the inductance and capacitance of the circuit. The fundamental tone of the voltage can be divided into an active component in phase with the current, and a reactive component phase shifted 90° forward of the current. In other words, the load acts as a resistive-inductive load.

In FIG. 6 there is shown an example of a series system of field lights of the kind to which the invention relates, and supplied from a Boucherot circuit via a current transformer 14 on the output side. The series line is loaded by a plurality of current transformers 2, each of which is connected to one or more light fittings on the secondary side. Via a switch 16 the Boucherot circuit is connected between the phases of an ordinary 3-phase main 18. Several such circuits can be connected distributed between the phases of the main to balance the 3-phase load.

As already mentioned, the network must be provided with protective means, since very high voltages will occur if a light fitting should form an open circuit, e.g., because of a lamp failure.

The triac 8 connected in parallel with the lamp 6 is adapted to be permanently turned on for short-circuiting the lamp, should the lamp fail. If the circuit for turning on the triac does not function, there is a second overvoltage protection in the form of a two-way Zener diode 20 connected across the lamp 6, and it will be short-circuited if an overvoltage occurs across the lamp. The Boucherot circuit is further protected by a short-circuiting means comprising two anti-parallel connected thyristors 22 across the output transformer 14. If the line with the transformers should form an open circuit, e.g., due to a lamp failure, and the voltage across the transformer 14 rises, the short-circuiting means 22 will start to function and short-circuit the Boucherot circuit. If the operation mechanism of the short-circuiting means 22 fails, a break-down will occur in the thyristor as a result of the overvoltage, and a permanent short-circuit will be established. Only a limited overvoltage will appear in the network for a very short time, and this overvoltage can be used to activate an alarm and to trigger the switch 16, with a delay of a few periods, so that the current has time to dissipate.

The network shown in FIG. 6 thus includes a threefold overvoltage protection.

As mentioned above in connection with the description of FIG. 3, each light fitting includes a local regulator unit 12 (not shown in FIG. 6). An example of such a unit is illustrated in FIG. 7.

The regulating and monitoring unit includes a conventional current transformer 2, connected between the power supply 4 and the lamp 6, as well as a triac 8 connected in parallel with the lamp 6, for regulating the light intensity of the latter. Thyristors can be used instead of the triac 8 for regulating illumination. The current transformer 2 drives a constant current through the secondary side, and with the triac 8 turned off the entire secondary side current flows through the lamp 6. By gradually turning on the triac 8 a gradually decreasing current flows through the lamp 6. The light intensity from the lamp can thus be regulated in the method explained in greater detail in connection with FIG. 8.

The regulating and monitoring unit illustrated in FIGS. 7 and 8 may be essentially divided into four parts: Power supply, detector, counter and amplifier.

The power supply includes an auxiliary transformer 24, which may be a current transformer having a high transformation ratio, the secondary side of which is connected to a rectifier bridge 26. The rectified output voltage from the rectifier bridge 26 is smoothed by a capacitor 28 and stabilized by a Zener diode 30.

The detector is connected to the A.C. terminals of the rectifier bridge 26, where the voltage has a square wave configuration and is in phase with the current in the line containing the light fittings. The steepness of the flanks of the square wave are improved with the aid of comparators 32, 34 and the square wave is converted into a short pulse PE, which is repeated every half period by transferring the output voltages of the comparators 32, 34 to the base of a transistor 36 via their respective capacitors 38, 40. This zero point detector will thus send a pulse PE for each zero crossing of the current in the line containing the light fittings.

The counter includes a crystal-controlled oscillator with a binary counter 42, which generates a clock pulse C1, which in turn clocks a following 8 bit binary count-down counter 44. The count-down counter 44 is activated by the pulse $\overline{PE}$ which sets it to the binary number N, to be found at the inputs JO, J1 . . . J7. After N counts, the count-down counter 44 delivers a short output pulse $\overline{CO}$. This pulse $\overline{CO}$ sets an RS flip-flop to zero 46, which is set to the "one" state by the pulse $\overline{PE}$. The pulse $\overline{CO}$ sets the output of the flip-flop 46 to 0, in which state it remains for the rest of the half period. The output signal P is amplified in the amplifier 48 and forms the control pulse turning on the triac 8, which is turned on for P=O. The pulse trains PE, CO and P are shown in the upper right-hand part of FIG. 8.

The binary number N is individual for each lamp 6 and is transferred to the address of the light fitting in question from a computer in the central control system. This transfer is most economically achieved by using the power cable, but it can also be effected via separate signal cables or by radio, as already mentioned.

As mentioned earlier, there is a means for switching the triac to a permanent on-state in case of a lamp failure, and there are also means (not shown) for sensing the condition of the lamp 6 and sending that information back to the central control system computer, which can thus keep count of which lamps need to be changed.

We claim:

1. A field lighting network, including a plurality of series-connected light fittings supplied from an A.C. main via a converter unit, adapted to convert a substantially constant voltage obtained from the main to a substantially constant current in departing current lines containing the light fittings, the network comprising:

a regulator unit (12) supplied with current being associated with each fitting or group of fittings for individual regulation of the current passing through the associated lamp or lamps (6), wherein each regulator unit (12) is disposed to receive control information on the power cable, and wherein the converter unit includes a Boucherot circuit having a series resonance circuit ($L_NC$), substantially tuned on the main frequency, and an additional inductance ($L_2$) in series with a load ($Z_{bel}$) connected to the converter unit, said inductance being preferably of equal magnitude as the inductance included in the series resonance circuit.

2. The network as claimed in claim 1, wherein the regulator unit (12) includes a counter (42, 44) synchronized to the zero crossings of the current, said counter being intended for current regulation controlled by a set binary number.

3. The network as claimed in claim 1, wherein the regulator unit includes a triac (8) or thyristor connected in parallel with the lamp (6) of the light fitting for regulating the current through the lamp.

4. The network as claimed in claim 1, wherein the regulator unit also includes means for monitoring the operational state of the lamp (6) in the light fitting.

5. The network as claimed in claim 1, further comprising an overvoltage protection component, preferably a two-way Zener diode (20), which is short-circuited when it is driven outside its operation range, said component being connected across each lamp (6).

6. The network as claimed in claim 3, wherein the triac (8) connected in parallel with the lamp is adapted to be forced in a permanent on-state in response to the occurrence of overvoltage across the lamp (6) for short-circuiting until a resetting signal is given.

7. The network as claimed in claim 6, further comprising a short-circuiting means (22) arranged across the primary side of a transformer (14) connected to the output of the Boucherot circuit for short-circuiting the transformer if an overvoltage condition occurs.

8. The network as claimed in claim 1, wherein the regulator units (12) are adapted for being controlled from a central control system.

* * * * *